United States Patent [19]

Hashimoto et al.

[11] 4,339,284

[45] Jul. 13, 1982

[54] METHOD OF PRODUCING NON-AGEING COLD ROLLED STEEL SHEETS

[75] Inventors: Osamu Hashimoto, Chiba; Susumu Sato, Ichihara; Tomoo Tanaka, Chiba, all of Japan

[73] Assignee: Kawasaki Steel Corporation, Kobe, Japan

[21] Appl. No.: 212,724

[22] PCT Filed: Feb. 27, 1980

[86] PCT No.: PCT/JP80/00032

§ 371 Date: Oct. 27, 1980

§ 102(e) Date: Oct. 27, 1980

[87] PCT Pub. No.: WO80/01811

PCT Pub. Date: Sep. 4, 1980

[30] Foreign Application Priority Data

Feb. 27, 1979 [JP] Japan ..... 54-22830

[51] Int. Cl.[3] ..... C21D 8/04; C21D 9/48

[52] U.S. Cl. ..... 148/12 C; 148/12 F; 148/36

[58] Field of Search ..... 75/123 N; 148/12 C, 148/12 F, 36, 12 D

[56] References Cited

U.S. PATENT DOCUMENTS 3,761,324 9/1973 Elias et al. ..... 148/12 C 3,865,637 2/1975 Matsudo et al. ..... 148/12 C

FOREIGN PATENT DOCUMENTS 54-1245 1/1979 Japan ..... 148/12 F

*Primary Examiner*—Peter K. Skiff

*Attorney, Agent, or Firm*—Balogh, Osann, Kramer, Dvorak, Genova & Traub

[57] ABSTRACT

A method of producing substantially non-ageing cold rolled steel sheets having a remarkably excellent deep drawing property, wherein an extra low-carbon steel is melted together with niobium in an amount of less than the necessary amount for fixing completely carbon contained in the extra low-carbon steel to prepare a molten steel, the molten steel is made into an ingot and then the ingot is slabbed, or the molten steel is continuously cast to produce a slab, the slab is subjected to a hot rolling and a cold rolling to produce a cold rolled sheet according to an ordinary method, and the cold rolled sheet is subjected to a box annealing.

6 Claims, 3 Drawing Figures

METHOD OF PRODUCING NON-AGEING COLD ROLLED STEEL SHEETS

Technical Field

The present invention relates to a method of producing non-ageing cold rolled steel sheets, and especially relates to a method of producing non-ageing cold rolled steel sheets having a remarkably excellent deep drawing property.

Background Art

Cold rolled steel sheets obtained by subjecting a rimmed steel or aluminum killed steel to decarburization and denitrogenization annealing in a box type open coil annealing furnace have a remarkably excellent deep drawing property, but the annealing cost is high and further cold rolled steel sheets having poor ageing resistance are sometimes produced due to incomplete decarburization and denitrogenization.

It has been well known that the carbon content of steel must be thoroughly reduced in order to improve the deep drawing property, that is, r value, of cold rolled steel sheet without carrying out decarburization and denitrogenization annealing. However, when a cold rolled steel sheet having a satisfactorily low carbon content of, for example, not higher than 0.02% is annealed, the following drawbacks (a), (b) and (c) occur.

(a) Since number of sites for forming nucleus for precipitating carbide is very small, it is impossible to fix solute carbon as carbide form by making the solute carbon precipitated as carbide during cooling step of box annealing. Therefore, a large amount of solute carbon remains in the annealed steel sheet, and when the annealed steel sheet is left to stand for a long period of time before the steel sheet is pressed, the steel sheet ages at room temperature.

(b) The ferrite matrix itself is low in strength due to the low carbon content, and what is worse, the ferrite matrix undergoes a change, so as to have a large ferrite crystal grain size after the box annealing. So, tensile strength is lowered, and wall break is caused during the drawing.

(c) Orange peel occurs during the pressing due to the large grain size of ferrite crystal.

As described above, there are various drawbacks in the conventional method, wherein an extra low-carbon steel having merely a carbon content of not more than 0.02% is used to improve the elongation and the $\bar{r}$ value.

In order to obviate these drawbacks, a non-aging low-carbon steel containing a small amount of niobium, which serves to fix solute carbon and to form fine crystal grains, and a method of producing it have been proposed in Japanese Patent Application Publication No. 35,002/78 claiming priority based on U.S. Pat. No. 3,761,324. According to this disclosure, it is necessary that at least 0.025% of uncombined niobium, that is, niobium which is not fixed by carbon, remains in the low-carbon steel.

However, the steel obtained by the above described method has a high $\bar{r}$ value of at least 1.8, but has a low elongation of not higher than 48% as compared with the elongation of 50–54% in the ordinary decarburized and denitrided steel. As the result, the low-carbon steel sheet obtained by the above described method has a non-ageing property, but has a poor deep drawing property. Moreover, the steel has a drawback that a large amount of an expensive alloy metal of niobium must be used in the production thereof.

The object of the present invention is to provide a method of producing non-ageing cold rolled steel sheets having a remarkably excellent deep drawing property which are free from the above described drawbacks in conventional method.

Disclosure of the Invention

The inventors have newly found out that it is effective to add niobium to an extra low-carbon steel in an amount less than the necessary amount for fixing completely carbon to convert partly the carbon into NbC, to precipitate the remaining carbon on the nuclei of the above described NbC during the cooling step of box annealing, and to utilize the effect of niobium for suppressing the grain growth of ferrite, and has accomplished the present invention.

That is, the feature of the present invention consists in a method of producing non-ageing cold rolled steel sheets having a remarkably excellent deep drawing property, comprising preparing a steel consisting of, in % by weight, not more than 0.01% of carbon, not more than 0.2% of silicon, 0.05–0.40% of manganese, not more than 0.02% of phosphorus, not more than 0.02% of sulfur, not more than 0.01% of nitrogen, acid-soluble aluminum in an amount of at least 1.8 times amount of nitrogen, niobium in an amount of log (Nb/C) of within the range of 0.10–1.00, and the remainder being iron and incidental impurities, and subjecting the steel to a hot rolling, a cold rolling and a box annealing according to an ordinary method.

BEST MODE OF CARRYING OUT THE INVENTION

The present invention will be explained in more detail referring to the accompanying drawings.

Figure 1:
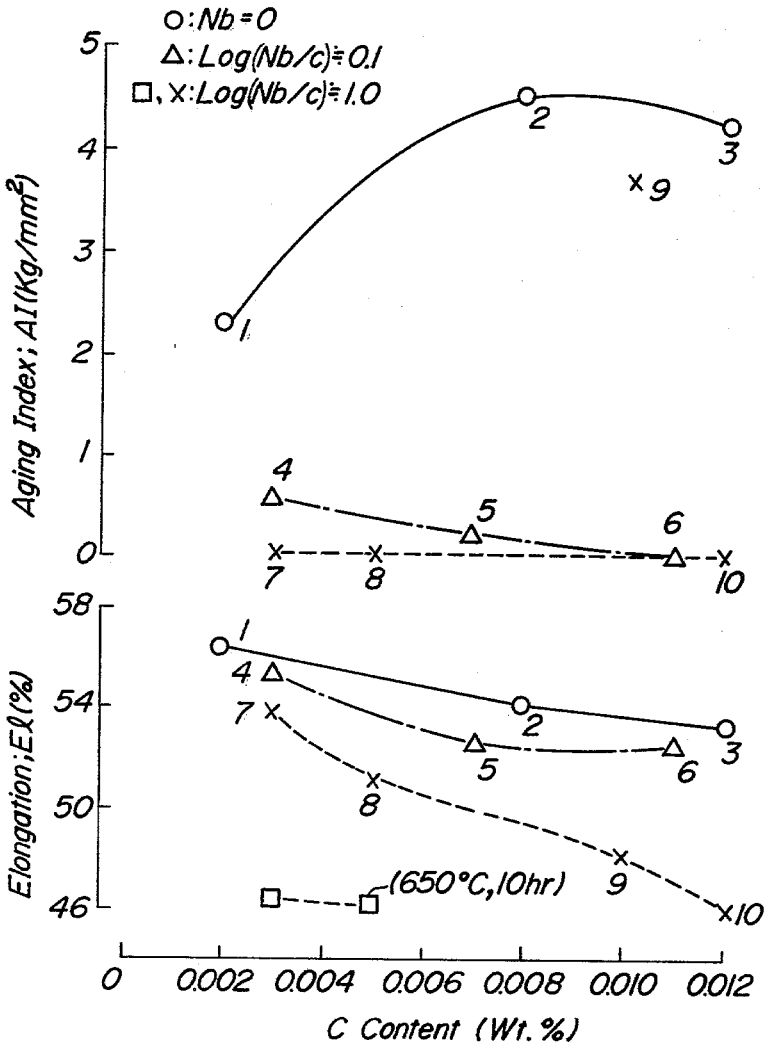
FIG. 1 is a graph illustrating a relation between the carbon content and the ageing index and elongation of the annealed steel sheets.
Figure 2:
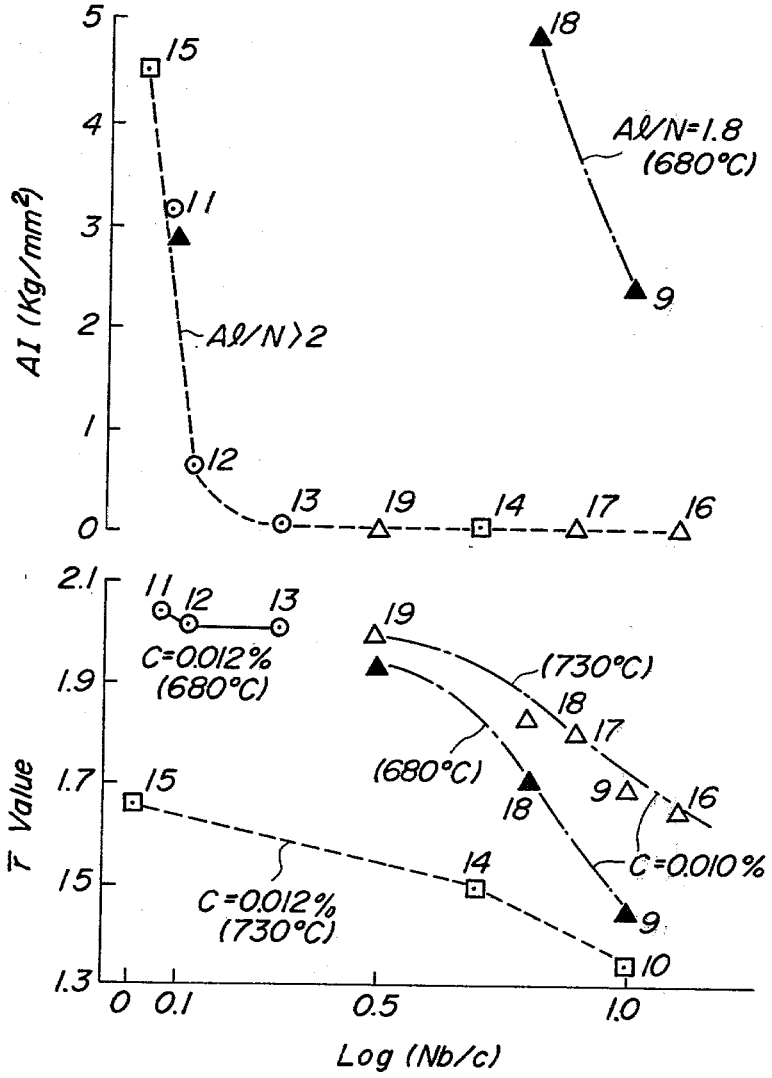
FIG. 2 is a graph illustrating a relation between the log (Nb/C) and the ageing index and $\bar{r}$ value of the annealed steel sheets.
Figure 3:
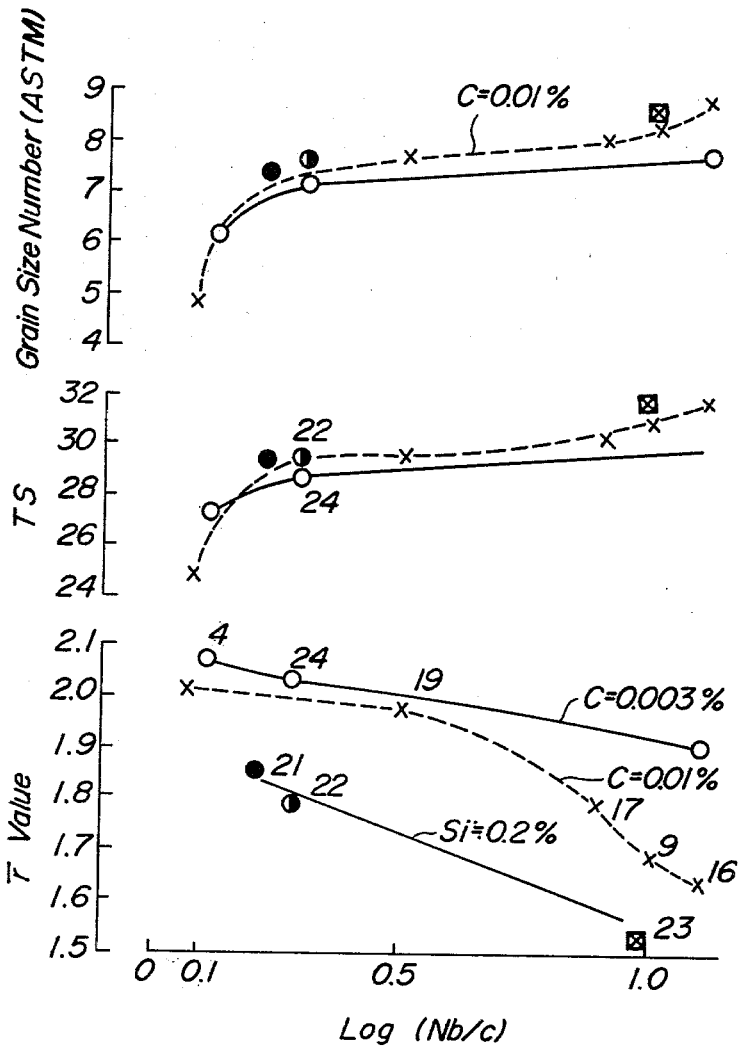
FIG. 3 is a graph illustrating a relation between the log (Nb/C) and the grain size number, tensile strength and $\bar{r}$ value of the annealed steel sheets.

Cold rolled steel sheets having a thickness of 0.8 mm and a composition shown in the following Table 1 were subjected to a recrystallization annealing at 650°–730° C. for 10–40 hours, and the mechanical properties of the above treated steel sheets are shown in FIGS. 1–3.

TABLE 1(a)

| | Component | | | | | | | | |
|---|---|---|---|---|---|---|---|---|---|
| steel | C | Si | Mn | P | S | Acid-soluble Al | Total N | Nb | (wt. %) log (Nb/C) |
| 1 | 0.002 | 0.13 | 0.15 | 0.015 | 0.011 | 0.013 | 0.0035 | Tr. | — |

TABLE 1(a)-continued

| steel | Component C | Si | Mn | P | S | Acid-soluble Al | Total N | Nb | (wt. %) log (Nb/C) |
|---|---|---|---|---|---|---|---|---|---|
| 2 | 0.008 | 0.01 | 0.15 | 0.011 | 0.013 | 0.035 | 0.0053 | Tr. | — |
| 3 | 0.012 | 0.08 | 0.10 | 0.012 | 0.018 | 0.042 | 0.0055 | Tr. | — |
| 4 | 0.003 | 0.12 | 0.05 | 0.013 | 0.011 | 0.011 | 0.0034 | 0.004 | 0.12 |
| 5 | 0.004 | 0.02 | 0.15 | 0.014 | 0.013 | 0.041 | 0.0052 | 0.009 | 0.11 |
| 6 | 0.011 | 0.01 | 0.12 | 0.010 | 0.015 | 0.044 | 0.0056 | 0.014 | 0.10 |
| 7 | 0.003 | 0.10 | 0.13 | 0.011 | 0.014 | 0.012 | 0.0035 | 0.030 | 1.00 |
| 8 | 0.005 | 0.02 | 0.15 | 0.018 | 0.011 | 0.046 | 0.0061 | 0.051 | 1.01 |
| 9 | 0.010 | 0.15 | 0.11 | 0.015 | 0.012 | 0.014 | 0.0078 | 0.103 | 1.01 |
| 10 | 0.012 | 0.02 | 0.12 | 0.014 | 0.013 | 0.042 | 0.0063 | 0.120 | 1.00 |
| 11 | 0.006 | 0.01 | 0.15 | 0.013 | 0.013 | 0.043 | 0.0058 | 0.007 | 0.07 |
| 12 | 0.006 | 0.05 | 0.13 | 0.014 | 0.014 | 0.044 | 0.0055 | 0.008 | 0.12 |
| 13 | 0.006 | 0.04 | 0.13 | 0.015 | 0.011 | 0.045 | 0.0063 | 0.012 | 0.30 |

TABLE 1(b)

| Steel | Component C | Si | Mn | P | S | Acid-soluble Al | Total N | Nb | (wt. %) log (Nb/C) |
|---|---|---|---|---|---|---|---|---|---|
| 14 | | 0.01 | 0.13 | 0.014 | 0.012 | 0.042 | 0.0072 | 0.060 | 0.70 |
| 15 | 0.012 | 0.01 | 0.13 | 0.014 | 0.011 | 0.038 | 0.0070 | 0.014 | 0.07 |
| 16 | 0.010 | 0.01 | 0.15 | 0.014 | 0.013 | 0.033 | 0.0077 | 0.126 | 1.10 |
| 17 | 0.010 | 0.02 | 0.15 | 0.013 | 0.014 | 0.035 | 0.0083 | 0.079 | 0.90 |
| 18 | 0.010 | 0.12 | 0.15 | 0.013 | 0.011 | 0.015 | 0.0083 | 0.063 | 0.80 |
| 19 | 0.010 | 0.02 | 0.15 | 0.013 | 0.012 | 0.028 | 0.0053 | 0.032 | 0.51 |
| 20 | 0.010 | 0.02 | 0.15 | 0.012 | 0.011 | 0.035 | 0.0050 | 0.012 | 0.08 |
| 21 | 0.003 | 0.19 | 0.08 | 0.013 | 0.011 | 0.045 | 0.0044 | 0.022 | 0.20 |
| 22 | 0.004 | 0.19 | 0.35 | 0.012 | 0.012 | 0.012 | 0.0043 | 0.008 | 0.30 |
| 23 | 0.009 | 0.20 | 0.33 | 0.014 | 0.013 | 0.011 | 0.0041 | 0.085 | 0.98 |
| 24 | 0.003 | 0.08 | 0.30 | 0.011 | 0.011 | 0.023 | 0.0051 | 0.006 | 0.30 |
| 25 | 0.003 | 0.15 | 0.31 | 0.011 | 0.011 | 0.015 | 0.0035 | 0.038 | 1.10 |

The inventors have evaluated the aging property of the steel sheet by the aging index AI. That is, a steel sheet is subjected to a tensile test, and the flow stress of the steel sheet is measured at its plastic strain of 7.5%. Then, the stress is once removed, and the steel sheet is artificially aged at 100° C. for 30 minutes, and then the yield stress of the steel sheet is measured by carrying out again a tensile test. The aging index (AI) of a steel sheet in the present invention means the difference between the flow stress and the yield stress thereof. According to the investigation by the inventors, a steel sheet having an AI of not more than 1 kg/mm$^2$ can be evaluated as substantially non-ageing.

FIG. 1 illustrates the effect of carbon content upon the elongation El (%) and ageing index AI (kg/mm$^2$) of an annealed steel sheet. Steel Nos. 1, 2 and 3 containing no niobium are excellent in the elongation, but have a high ageing index AI of 2.3–4.5 kg/mm$^2$. While, steel Nos. 4–6 containing a small amount of niobium have a very low ageing index AI of not more than 1 kg/mm$^2$. In steel Nos. 7–10 containing a large amount of niobium, the elongation decreases noticeably corresponding to the increase of the carbon content.

FIG. 2 illustrates the effect of the weight ratio of niobium content to carbon content shown by log (Nb/C) upon the $\bar{r}$ value and AI value of an annealed steel sheet at different carbon contents and annealing temperatures and at different ratios of acid-soluble aluminum/nitrogen. The reason why log (Nb/C) is used in place of Nb/C is that the influence of the ratio of niobium content to carbon content in the steel is minutely examined within the range of Nb/C of 1–2. In steel Nos. 10, 14 and 15 having a carbon content of higher than 0.012%, a steel sheet having a higher niobium content has a lower $\bar{r}$ value, and even when the niobium content is low or the annealing temperature is high, the $\bar{r}$ value is not so high and AI is high.

While, when steel sheets having a carbon content of not higher than 0.01% are annealed at a high temperature, the annealed steel sheets have a high $\bar{r}$ value even in the case of high niobium content. Accordingly, the carbon content in the steel of the present invention should be limited to not higher than 0.010%. When the value of log (Nb/C) exceeds 1.0, the $\bar{r}$ value is low, and therefore the niobium content in the steel of the present invention should be not higher than 1.0 calculated as log (Nb/C). When the ability of carbon and niobium for forming fine crystal grains and the adverse influence thereof upon the elongation of the annealed steel sheet are taken into consideration, carbon content in a steel of not higher than 0.007% and log (Nb/C) value of not more than 0.9 are advantageously used in the present invention.

However, even when a steel has a log (Nb/C) value of 1.0, if the steel contains solute nitrogen, it is sometimes impossible to obtain a steel sheet having an AI of not higher than 1 kg/mm$^2$. However, the addition of a large amount of niobium to a steel in order to reduce the AI of the annealed steel sheet is disadvantageous for the deep drawing property thereof, and therefore it is necessary to add aluminum to steel in order to fix the nitrogen. The amount of aluminum should be such that the ratio of acid-soluble aluminum/total nitrogen is at least 1.8, preferably at least 5.0. Since the object of the use of aluminum is to satisfy the above described condition and to fix nitrogen, the use of excess amount of aluminum is not preferable. Accordingly, the content of acid-soluble aluminum in the steel of the present invention is preferably not higher than 0.060%.

FIG. 3 illustrates the influence of log (Nb/C) value of a steel upon the tensile strength (TS), crystal grain size and $\bar{r}$ value of an annealed steel sheet. Steel sheets containing niobium and having a log (Nb/C) value of at least 0.1 have a tensile strength (TS) of at least 27 kg/mm$^2$ even when the steel sheets have a low carbon content, and the steel sheets satisfy the object of the present invention. However, in order to obtain surely a steel sheet having a high strength enough to prevent the wall break, it is advantageous that log (Nb/C) value is at least 0.2. Further, when log (Nb/C) value is at least 0.1, fine crystal grains can be obtained, and log (Nb/C) value of at least 0.2 is advantageous in order to prevent surely the orange peel.

In the above described experimental data, the amounts of carbon and niobium and the ratio of acid-soluble aluminum to nitrogen, which amounts and ratio are necessary for attaining the object of the present invention, have been explained.

The amount of components other than the above described elements and the treating condition are the same as those commonly used, and are as follows.

1. Amount of components:

Silicon: Silicon can be added to steel up to 0.2% in order to raise the strength of the steel. However, the use of more than 0.2% of silicon lowers the $\bar{r}$ value and is not preferable.

Manganese: Manganese is added to steel in order to prevent the red shortness of the steel during the hot rolling. When the content of manganese in a steel is less than 0.05%, the red shortness of the steel can not be prevented, while when the manganese content in a steel is more than 0.4%, the $\bar{r}$ value and elongation of the annealed steel sheet lower. The manganese content is preferably within the range of 0.05–0.20%.

Sulfur and phosphorus: Amounts of both sulfur and phosphorus contained in steel as an impurity must be limited to not more than 0.03%, and is preferably not more than 0.02%.

Nitrogen: When the nitrogen content in a steel is increased, aluminum must be used in a larger amount corresponding to the amount of nitrogen, and the elongation of the annealed steel sheet lowers. Therefore, the nitrogen content in steel must be not more than 0.01%.

In addition to the above described elements, the following elements can be occasionally contained in the steel sheet of the present invention.

Rare earth metal and calcium: These elements can be added to steel in an amount of not more than 0.01% in order to adjust the shape of sulfides contained in the steel.

Boron: Boron can be added to steel in an amount of not more than 0.01% in order to fix nitrogen in the form of BN.

Copper: Copper can be added to steel in an amount of not more than 0.3% in order to give a corrosion resistance to the steel sheet.

2. Treating condition

Steel making and ingot making: The steel making and ingot making conditions are not particularly limited. Steel is refined by the use of a commonly known oxygen top-blown converter, bottom blown converter or electric steel making furnace, and the refined steel is occasionally subjected to a RH or DH degassing treatment and then to a decarburization treatment. The above treated steel is continuously cast to produce a slab, or is made into an ingot and then the ingot is slabbed.

Rolling: An ordinary rolling method can be used. The slab is hot rolled into a hot rolled steel strip. The coiling temperature at the hot rolling is not particularly limited, but is preferred to be within the range of 500°–800° C. The above obtained hot rolled steel strip is then cold rolled. In the cold rolling, the reduction is advantageously within the range of 50–90%.

Annealing condition: The annealing is carried out by a box annealing. When a cold rolled steel strip is uniformly heated in a sufficiently long period of time and is gradually cooled in a sufficiently slow rate, the box annealing can be carried out by any of tight coil annealing and open coil annealing. However, the annealing temperature must be not lower than 680° C., and when the annealing temperature exceeds 900° C., the transformation of the steel occurs, and an annealing temperature of higher than 900° C. must not be used.

Further, the tight coil annealing should be carried out at a temperature of not higher than 750° C. in order to prevent the stickying between steel sheets. When it is intended to obtain higher $\bar{r}$ value and elongation value by carrying out an annealing at a temperature higher than 750° C., the annealing can be carried out, for example, by an open coil annealing.

The following examples are given for the purpose of illustration of this invention.

EXAMPLE

A steel having a composition shown in the following Table 2 was melted, and the melted steel was continuously cast into a slab. The slab was heated at a temperature of 1,200°–1,300° C., and then formed into a hot rolled coil by means of a hot strip mill. In this hot rolling, the final rolling temperature was kept at 880°–930° C., and the coiling temperature was kept at 520°–700° C.

The resulting hot rolled coil was pickled, and then cold rolled at a reduction of 70–80% to obtain a cold rolled tight coil. The resulting tight coil as such was subjected to a box annealing at 710° C. for 30 hours. The properties of the resulting products are shown in the following Table 3.

TABLE 2

| | Component | | | | | | | | | |
|---|---|---|---|---|---|---|---|---|---|---|
| Steel | C (%) | Si (%) | Mn (%) | P (%) | S (%) | Acid-soluble Al (%) | Total N (%) | Nb (%) | log (Nb/C) | Acid-soluble Al/N |
| a | 0.004 | 0.03 | 0.15 | 0.012 | 0.011 | 0.033 | 0.0061 | 0.007 | 0.24 | 5.4 |
| b | 0.005 | 0.05 | 0.15 | 0.013 | 0.010 | 0.021 | 0.0077 | 0.023 | 0.66 | 2.7 |
| c | 0.003 | 0.19 | 0.15 | 0.013 | 0.010 | 0.015 | 0.0065 | 0.014 | 0.67 | 2.3 |
| d | 0.008 | 0.18 | 0.07 | 0.013 | 0.011 | 0.011 | 0.0053 | 0.016 | 0.30 | 2.1 |
| e | 0.010 | 0.01 | 0.09 | 0.013 | 0.011 | 0.043 | 0.0065 | 0.089 | 0.95 | 6.6 |

TABLE 2-continued

| Steel | Component | | | | | | | | | |
|---|---|---|---|---|---|---|---|---|---|---|
| | C (%) | Si (%) | Mn (%) | P (%) | S (%) | Acid-soluble Al (%) | Total N (%) | Nb (%) | log (Nb/C) | Acid-soluble Al/N |
| f | 0.005 | 0.02 | 0.14 | 0.010 | 0.009 | 0.035 | 0.0042 | 0.041 | 0.91 | 8.3 |

TABLE 3

| Steel | Property | | | | | |
|---|---|---|---|---|---|---|
| | Thickness (mm) | YP (kg/mm²) | TS (kg/mm²) | El (%) | $\bar{r}$ | AI (kg/mm²) |
| a | 0.8 | 16 | 29 | 56.5 | 2.03 | 0.1 |
| b | " | 17 | 29.5 | 53 | 1.90 | 0 |
| c | 0.7 | 18 | 31 | 55 | 1.86 | 0 |
| d | 0.8 | 17 | 30 | 54 | 1.90 | 0.2 |
| e | " | 19 | 31 | 51 | 1.87 | 0 |
| f | " | 16 | 32 | 52 | 1.92 | 0 |

Industrial Applicability

According to the present invention, substantially non-aging cold rolled steel sheets having no surface defects and having a remarkably excellent deep drawing property can be produced in a very stable manner with the use of a very small amount of an expensive alloy element of niobium.

As the results, the present invention can supply steel sheets used for producing fender portion, gasoline tank and the like of automobile, which have a complicated shape and are formed through a press operation under a severe condition, and the present invention is very useful in industry.

We claim:

1. A method of producing non-ageing cold rolled steel sheets having a remarkably excellent deep drawing property or $\bar{r}$ value of not lower than 1.86, an elongation that is not lower than 50%, and an ageing index that is not more than 1.0 KG/mm², the method comprising preparing a steel consisting of, in % by weight, not more than 0.01% of carbon, not more than 0.2% of silicon, 0.05–0.40% of manganese, not more than 0.02% of phosphorus, not more than 0.02% of sulfur, not more than 0.01% of nitrogen, acid-soluble aluminum in an amount not less than 0.005%, and of at least 1.8 times amount of nitrogen, niobium in an amount less than the necessary amount for completely fixing carbon and not less than 0.001%, and in an amount of log (Nb/C) of within the range of 0.10–1.00, and the remainder being iron and incidental impurities, and subjecting the steel to a hot rolling, a cold rolling and box annealing.

2. A method according to claim 1, wherein said steel contains not more than 0.06% by weight of acid-soluble aluminum.

3. A method according to claim 1 or 2, wherein said steel contains, in % by weight, not more than 0.007% of carbon, 0.05–0.20% of manganese, not more than 0.007% of nitrogen, not more than 0.06% of acid-soluble aluminum, the ratio of the acid-soluble aluminum to the nitrogen being at least 5, and further contains niobium in an amount of log (Nb/C) of within the range of 0.2–0.9.

4. A method according to any one of claims 1 and 2, wherein said steel contains at least one element selected from the group consisting of rare earth metal, calcium, boron and copper, the amount of rare earth metal, calcium or boron being not more than 0.01% by weight and the amount of copper being not more than 0.3% by weight.

5. A method according to any one of claims 1 and 2, wherein said box annealing is a tight coil annealing carried out at a temperature range of 680°–750° C.

6. A method according to any one of claims 1 and 2, wherein said box annealing is an open coil annealing carried out at a temperature range of 680°–900° C.

* * * * *